US011904251B2

(12) United States Patent
Muraki et al.

(10) Patent No.: US 11,904,251 B2
(45) Date of Patent: Feb. 20, 2024

(54) TOP TOY

(71) Applicant: TOMY COMPANY, LTD., Tokyo (JP)

(72) Inventors: Makoto Muraki, Tokyo (JP); Yohei Bando, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 330 days.

(21) Appl. No.: 17/320,740

(22) Filed: May 14, 2021

(65) Prior Publication Data

US 2022/0016536 A1 Jan. 20, 2022

(30) Foreign Application Priority Data

Jul. 14, 2020 (JP) ..... 2020-120676

(51) Int. Cl.
*A63H 1/02* (2006.01)
*A63H 1/00* (2019.01)

(52) U.S. Cl.
CPC ..... *A63H 1/02* (2013.01); *A63H 1/00* (2013.01)

(58) Field of Classification Search
CPC ..... A63H 1/00; A63H 1/02; A63H 1/20
See application file for complete search history.

(56) References Cited

U.S. PATENT DOCUMENTS 6,626,729 B2 * 9/2003 Osawa ..... A63H 1/00 446/250
9,737,820 B2 * 8/2017 Cai ..... A63H 1/18
10,118,103 B2 * 11/2018 Muraki ..... A63H 1/02
10,525,365 B2 * 1/2020 Muraki ..... A63H 1/02
(Continued)

FOREIGN PATENT DOCUMENTS

CN 205516445 U * 8/2016
CN 209254108 U * 8/2019
(Continued)

OTHER PUBLICATIONS

CN209254108U (Year: 2019).*
CN205516445U (Year: 2016).*
JP6632088B1 (Year: 2020).*

*Primary Examiner* — Eugene L Kim
*Assistant Examiner* — Alyssa M Hylinski
(74) *Attorney, Agent, or Firm* — IP Business Solutions, LLC

(57) ABSTRACT

A top toy includes a first shaft side component and a trunk part. The trunk part includes a trunk body, a moving body being rotatably configured with respect to the trunk body, and a locking mechanism. The locking mechanism is configured to lock releasably the moving member at a first position. The first shaft side component is rotatably configured with respect to the trunk part between first and second rotation positions. The trunk part is rotatably configured with respect to the first shaft side component when an external force is applied to the trunk part. The first shaft side component includes is a first projecting part. When the first projecting part is in contact with the locking mechanism, the locking mechanism is configured to release the moving member from the first position. The first and second shaft side components are interchangeable.

7 Claims, 13 Drawing Sheets

(56) References Cited

U.S. PATENT DOCUMENTS

| | | | | |
|---|---|---|---|---|
| 2009/0253344 | A1* | 10/2009 | Ujita | A63H 1/02 446/256 |
| 2011/0256796 | A1* | 10/2011 | Ujita | A63H 1/00 446/264 |
| 2019/0111352 | A1* | 4/2019 | Muraki | A63H 1/04 |
| 2019/0262729 | A1* | 8/2019 | Horikoshi | A63H 1/04 |
| 2020/0114271 | A1* | 4/2020 | Muraki | A63H 1/02 |

FOREIGN PATENT DOCUMENTS

| | | | | |
|---|---|---|---|---|
| JP | 2004-129829 | A | 4/2004 | |
| JP | 6632088 | B1 * | 1/2020 | A63H 1/04 |

* cited by examiner

TOP TOY

CROSS-REFERENCE TO THE RELATED APPLICATION

The present application claims priority under 35 U.S.C. 119 to Japanese Patent Application No. 2020-120676 filed on Jul. 14, 2020. The entire content of Japanese Patent Application No. 2020-120676 is incorporated herein by reference.

BACKGROUND

Technical Field

The present invention relates to a top toy.

Background Art

Items such as that noted in Patent Document 1, for example, have been known as top toys from the past. This top toy has a configuration in which a holding mechanism of a protruding moving part built into the toy body interior does a sliding operation vertically due to impact force, and when the holding mechanism is released by the sliding operation, the configuration is such that the protruding moving part is made to protrude by centrifugal force due to rotational force given to the toy body or the elastic effect of an elastic member.

PRIOR ART DOCUMENTS

[Patent Document 1] Unexamined Patent Publication No. 2004-129829

SUMMARY

Problems the Invention is Intended to Solve

However, with the top toy noted in the abovementioned Patent Document 1, this item did not allow the player to control the timing of transformation, and was lacking in strategic qualities.

The present invention was created considering these points, and its purpose is to provide a top toy that has excellent strategic qualities, with it possible for the player to customize the timing of transformation.

Means for Solving the Problems

A top toy for rotating in a first direction on a floor around a central axis extending in an axial direction is provided. The top toy includes first and second shaft side components, and a trunk part. The first shaft side component extends in the axial direction. The trunk part is configured on the first shaft part component. The trunk part includes a trunk body, a moving body being rotatably configured with respect to the trunk body, and a locking mechanism. The moving member is movable between first and second positions in the axial direction. The locking mechanism is configured to lock releasably the moving member at the first position. The first shaft side component being rotatably configured with respect to the trunk part between first and second rotation positions with the axial direction as a center. The trunk part is rotatably configured with respect to the first shaft side component in a second direction being opposite to the first direction when an external force is applied to the trunk part.

The first shaft side component includes a first projecting part. When the first projecting part is in contact with the locking mechanism, the locking mechanism is configured to release the moving member from the first position. The first and second shaft side components are interchangeable.

DETAILED DESCRIPTION OF THE PREFERRED EMBODIMENT

Figure 1:
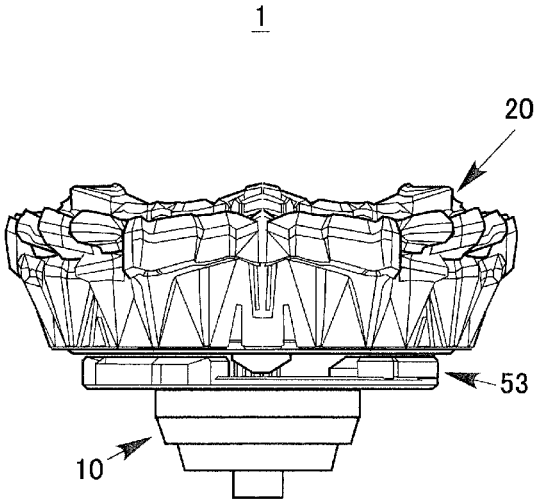
FIG. 1 is a front view of a top toy of an embodiment.

Following, a top toy of the present invention is explained based on an embodiment shown in the drawings.

Figure 2:
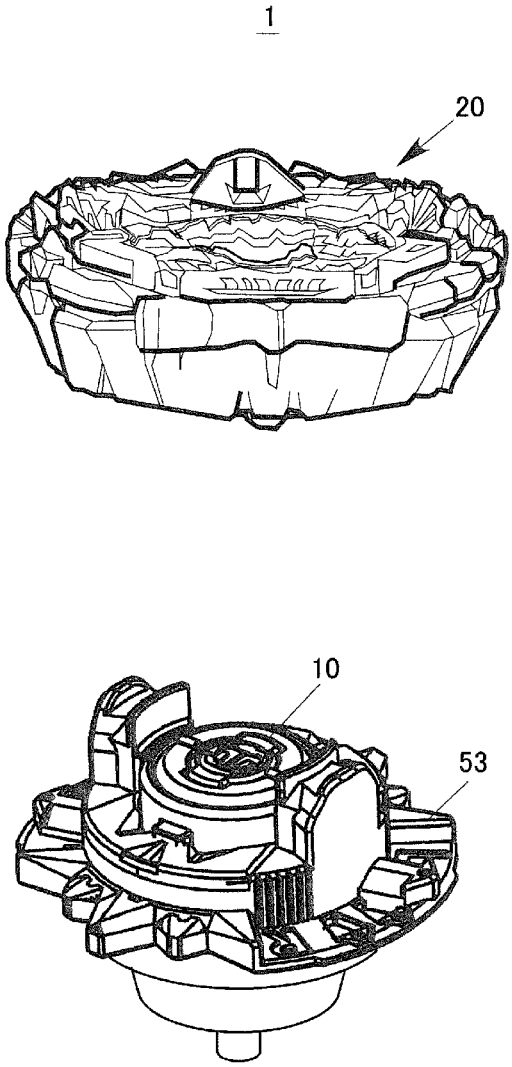
FIG. 2 is an exploded perspective view of the top toy.

FIG. 1 is a front view of a top toy 1 of an embodiment, and FIG. 2 is an exploded perspective view of the top toy.

The top toy 1 of the present embodiment is the top toy that can be used in a so-called battle game. This top toy 1 is used in a battle game in which the other party top toy 1 is disassembled by impact force by colliding with each other, etc., for example.

Broadly speaking, this top toy 1 comprises a shaft part 10, a flywheel 53, and a trunk part 20. In this specification, the items called shaft side components include the shaft part 10, and also include the parts that rotate integrally with the shaft part 10 (with the present embodiment, for example, the flywheel 53 that rotates integrally with the shaft part 10).

Shaft Part 10

Figure 3:
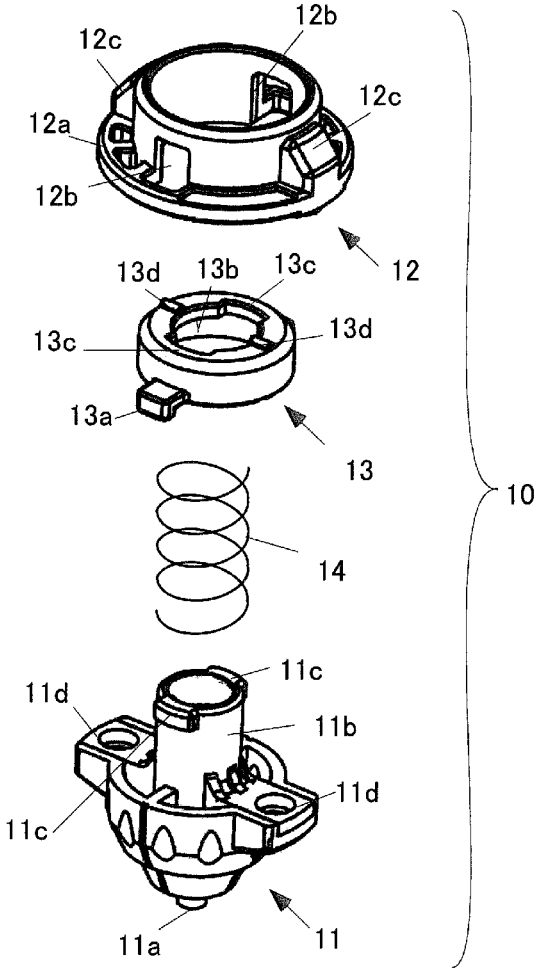
FIG. 3 is an exploded perspective view of a shaft part in the top toy.

FIG. 3 is an exploded perspective view of the shaft part 10 in the top toy 1.

The shaft part 10 has a rotation shaft 11*a* for landing. A cylindrical body 11*b* is attached on top of the rotation shaft 11*a*. Claws 11*c*, 11*c* that jut radially outward are formed on the peripheral surface top edge of the cylindrical body 11*b*.

The rotation shaft 11*a* and the cylindrical body 11*b* configure a shaft lower part 11, and jutting parts 11*d*, 11*d* are formed on this shaft lower part 11.

The shaft part 10 also has a cylinder body 12. A flange 12*a* is formed on the outer periphery bottom edge of this cylinder body 12, and square holes 12*b*, 12*b* are formed over the flange 12*a* from the peripheral wall of the cylinder body 12. Furthermore, protruding parts 12*c*, 12*c* are formed on the peripheral wall of the cylinder body 12.

The shaft part 10 also has a ring 13. Hook-shaped legs 13*a*, 13*a* are formed on the bottom edge outer periphery of this ring 13 (see FIG. 4). Also, a hole 13*b* is formed in the ceiling wall center of the ring 13, and notch parts 13*c*, 13*c* are formed on a portion of the edge of that hole 13*b*. Furthermore, protrusions 13*d*, 13*d* extending in the radial direction are formed on the ceiling wall top surface.

Figure 4:
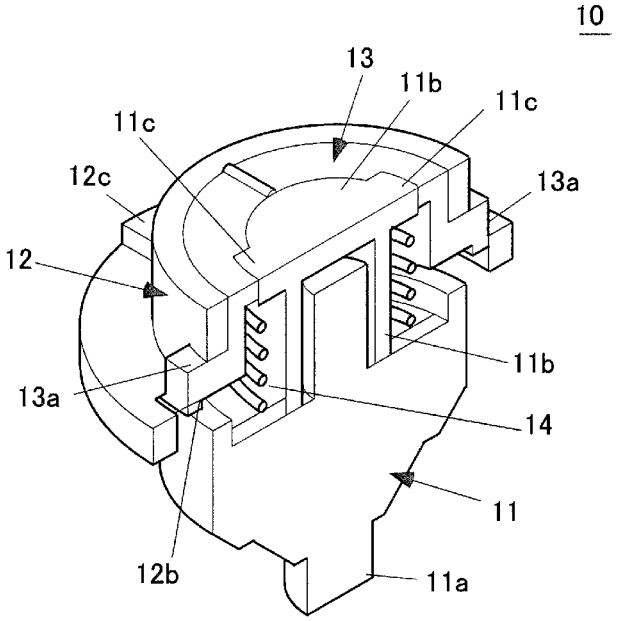
FIG. 4 is a cross section view showing half of the shaft part of FIG. 3.

FIG. 4 is a cross section view showing half of the shaft part 10.

The shaft part 10 has a coil spring 14 wound around the cylindrical body 11*b* of the shaft lower part 11, and from above that, matches the claws 11*c*, 11*c* and the notch parts 13*c*, 13*c* and engages the ring 13 on the cylindrical body 11*b*, and furthermore, the legs 13*a*, 13*a* and the square holes 12*b*, 12*b* are matched to cover the cylinder body 12, and assembly is done by screws (not illustrated) passed through the jutting parts 11*d*, 11*d* being screwed into the protruding parts 12*c*, 12*c*.

With the shaft part 10 configured in this way, the ring 13 is energized upward by the coil spring 14, and the upward movement of the ring 13 is regulated by the legs 13*a*, 13*a* butting against the upper edge of the square holes 12*b*, 12*b*.

Flywheel 53

Figure 5:
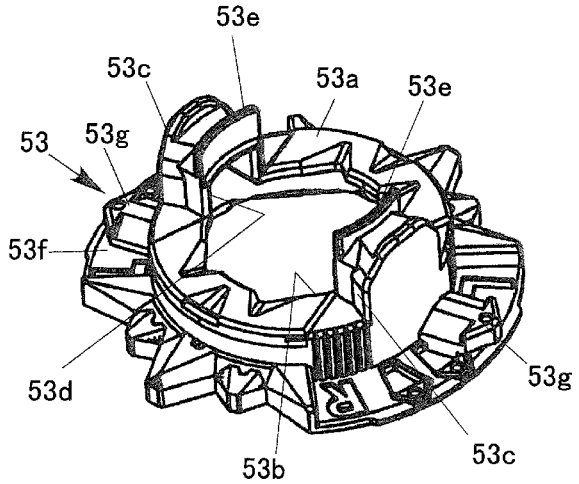
FIG. 5 is a top side perspective view of a flywheel.
Figure 6:
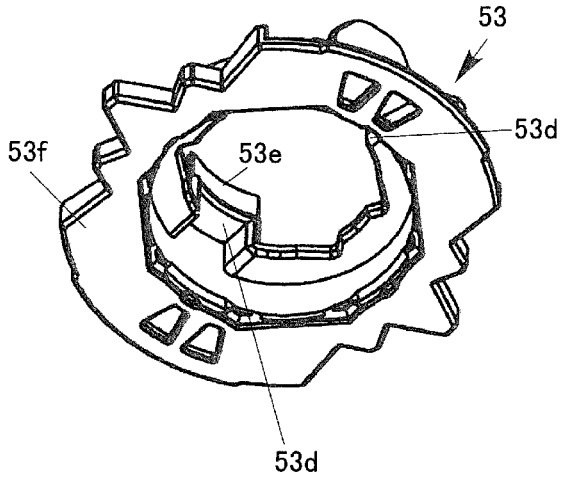
FIG. 6 is a bottom side perspective view of the flywheel.

FIG. 5 is a top side perspective view of the flywheel 53, and FIG. 6 is a bottom side perspective view of the flywheel 53.

The flywheel 53 is used covering the shaft part 10 from above. The plan view center part of the flywheel 53 is elevated with respect to the peripheral part, and a hole 53*b* in which the cylinder body 12 of the shaft part 10 is inserted from below is formed on the ceiling wall of an elevation part 53*a*.

Bulging parts 53*c*, 53*c* that bulge facing upward of the shaft part 10 are formed on the ceiling wall of the elevation part 53*a* of the flywheel 53. Recesses 53*d*, 53*d* that open downward and inward of the flywheel 53 are formed below each bulging part 53*c*. The protruding parts 12*c*, 12*c* of the shaft part 10 are inserted from below in these recesses 53*d*, 53*d*. The top surface of the flange 12*a* of the shaft part 10 is abutted on the ceiling wall bottom surface of the elevation part 53*a*.

Also, projecting pieces 53*e*, 53*e* extending upward are formed on the top of the bulging parts 53*c*, 53*c* of the flywheel 53. These bulging parts 53*c*, 53*c* are inserted from below in arc-shaped holes 21*d*, 21*d* described later.

Figure 7:
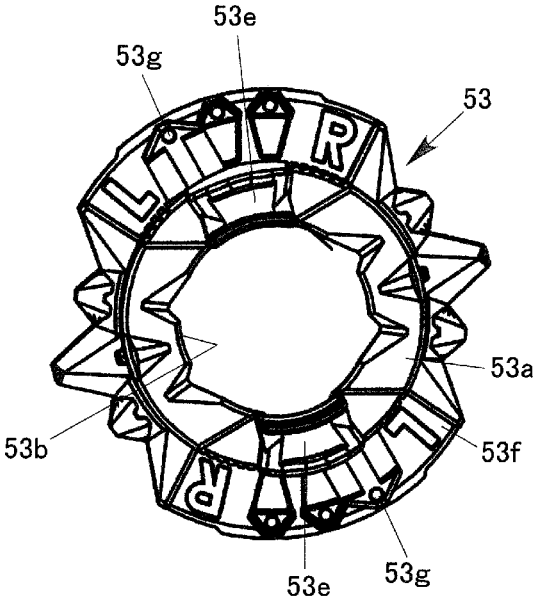
FIG. 7 is a plan view of the flywheel.

Furthermore, projections 53*g*, 53*g* that bulge upward as shown in FIG. 5 and FIG. 7 are formed on the top surface of a plan view peripheral part 53*f* of the flywheel 53. These projections 53*g*, 53*g* are items that activate gimmicks described later.

Figure 8:
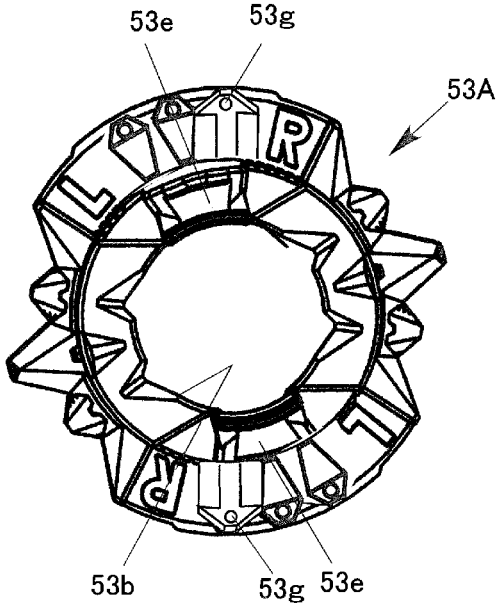
FIG. 8 is a plan view of another flywheel.

FIG. 8 is a plan view of another flywheel 53A. This other flywheel 53A has approximately the same configuration as the flywheel 53 shown in FIG. 7, etc. The point of difference from the flywheel 53 shown in FIG. 7, etc., for this other flywheel 53A is the formation position of the projections 53*g*, 53*g*. By changing the formation position of these projections 53*g*, 53*g*, it is possible to change the activation timing of the gimmicks described later.

Trunk Part 20

Figure 9:
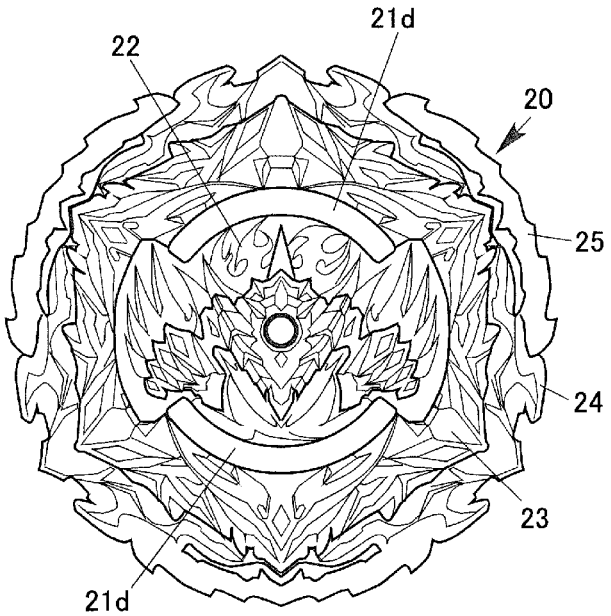
FIG. 9 is a plan view of a trunk part.
Figure 10:
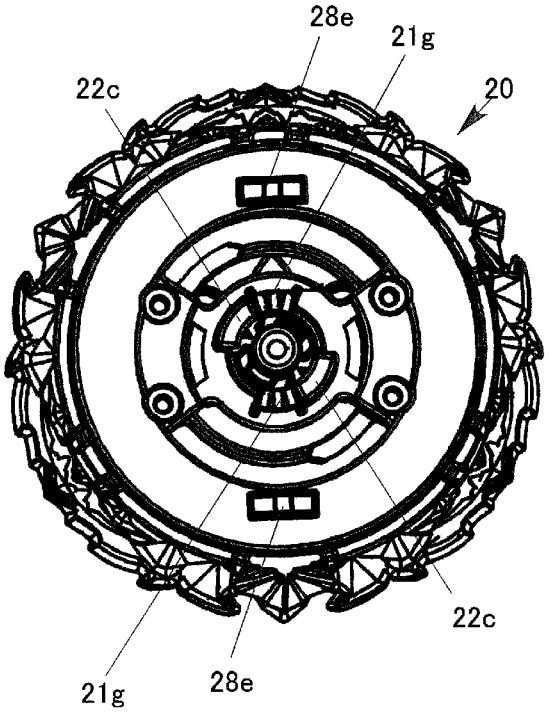
FIG. 10 is a bottom view of the trunk part.
Figure 11:
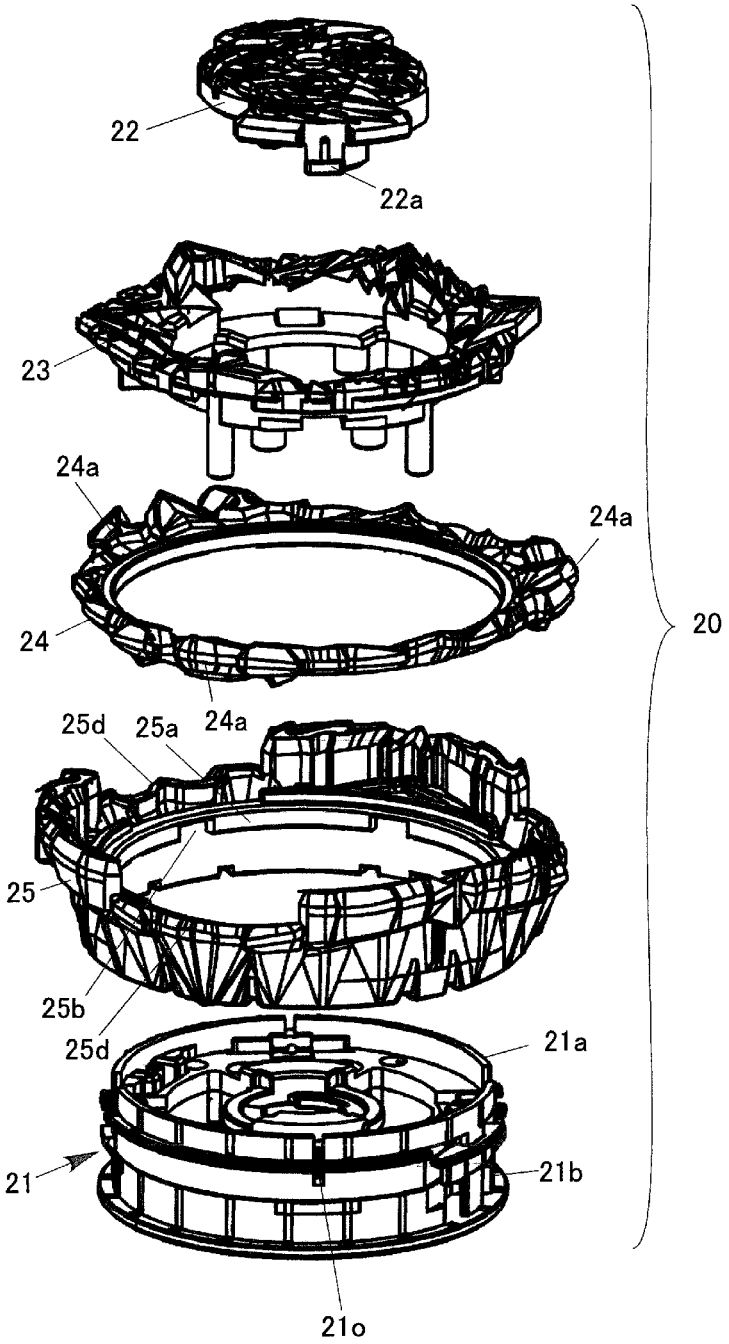
FIG. 11 is an exploded perspective view of the trunk part seen from above.
Figure 12:
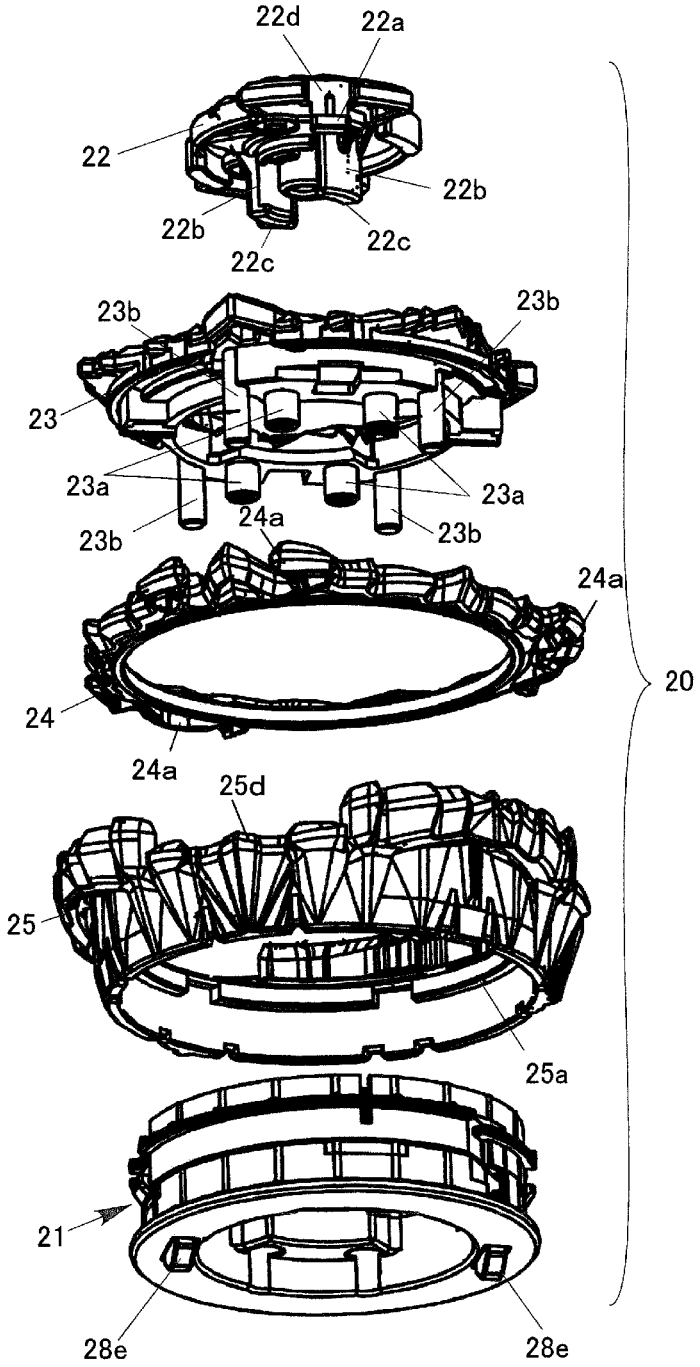
FIG. 12 is an exploded perspective view of the trunk part seen from below.

FIG. 9 is a plan view of the trunk part 20, FIG. 10 is a bottom view of the trunk part 20, FIG. 11 is an exploded perspective view of the trunk part 20 seen from the top surface side, and FIG. 12 is an exploded perspective view of the trunk part 20 seen from the bottom surface side.

As shown in FIG. 11 and FIG. 12, the trunk part 20 comprises a trunk body 21. A tip 22, an upper ring 23, a middle ring 24, and a lower ring 25 are attached to this trunk body 21. The middle ring 24 and the lower ring 25 constitute a moving member.

Figure 13:
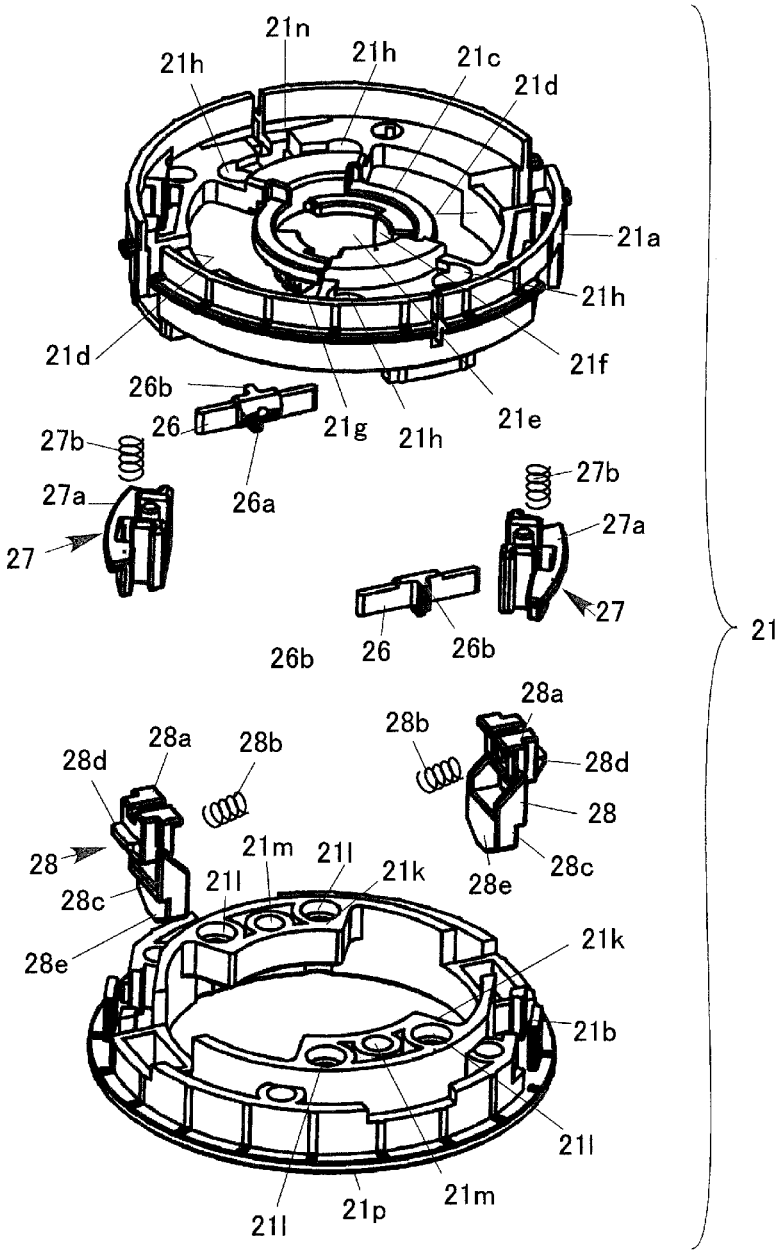
FIG. 13 is an exploded perspective view of a trunk body seen from above.

The trunk body 21 is configured in a cylindrical form. As shown in FIG. 13, the trunk body 21 comprises an upper trunk part 21*a* and a lower trunk part 21*b*.

Of these, on the upper trunk part 21*a*, a bridge 21*c* is formed hanging across two parts facing sandwiching the shaft center.

In the upper trunk part 21*a*, arc-shaped holes 21*d*, 21*d* are formed on both sides of the bridge 21*c*. The bulging part 53*c* of the flywheel 53 is inserted from below in each arc-shaped hole 21*d*.

Figure 14:
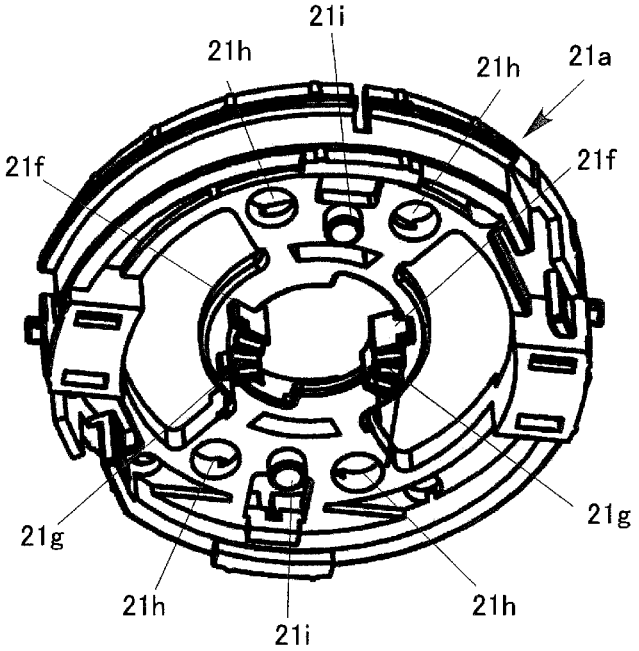
FIG. 14 is a bottom side perspective view of the upper trunk part.

A hole 21*e* is also formed in the center of the bridge 21*c*. As shown in FIG. 14 (bottom side perspective view of the upper trunk part 21*a*), resistance members 21*f*, 21*f* that extend downward are formed below the edge of the hole 21*e*. Teeth 21*g* are formed on the bottom edge of each resistance member 21*f*. Teeth 21*g*, 21*g* abut protrusions 13*d*, 13*d* of the shaft part 10 from above.

Furthermore, boss holes 21*h*, 21*h* are formed at prescribed intervals in the circumferential direction on each fan-shaped end part of the bridge 21*c*. One each of a boss with a screw hole 23*a* of the upper ring 23 is fitted in each of the boss holes 21*h*. Also, on the bottom surface of each fan-shaped end part of the bridge 21*c*, a boss 21*i* is provided in the part between the boss holes 21*h*, 21*h* (see FIG. 14). This boss 21*i* is fitted with a boss hole 21*m* of the lower trunk part 21*b*.

Figure 15:
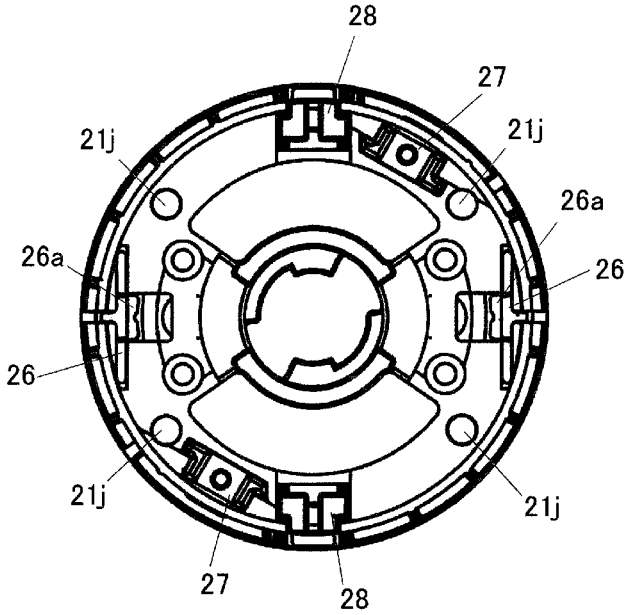
FIG. 15 is a plan view of the trunk body.
Figure 16:
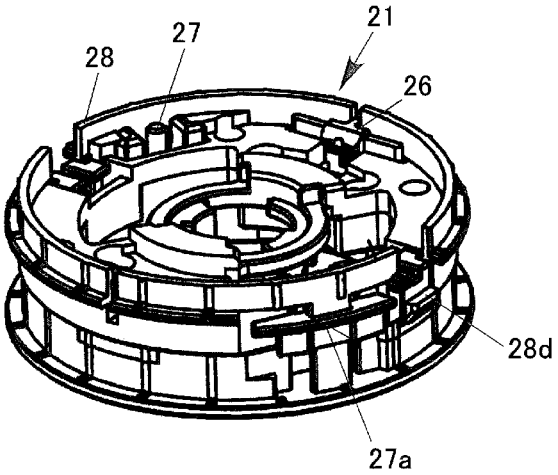
FIG. 16 is a top side perspective view of the trunk body.
Figure 17:
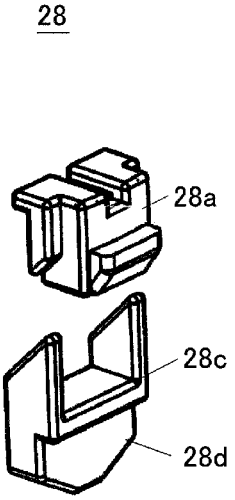
FIG. 17 is an exploded view showing a portion of a locking mechanism.

As shown in FIG. 15 (top view of the trunk part 20), other boss holes 21*j*, 21*j* are formed on both sides of each fan-shaped end part of the upper trunk part 21*a*. A boss 23*b* of the upper ring 23 is fitted in each boss hole 21*j*.

As shown in FIG. 13, on the inner periphery of the lower trunk part 21*b*, a fan-shaped jutting part 21*k* is formed at a location corresponding to each fan-shaped end part of the bridge 21*c*. On each fan-shaped jutting part 21*k*, boss holes 211, 211 are formed at locations corresponding to the bosses with a screw hole 23*a*, 23*a*. Also, on each fan-shaped jutting part 21*k*, a boss hole 21*m* is formed at a location corresponding to each of the bosses 21*i*. Also, in a state with the boss 21*i* fitted in the boss hole 21*m* from above, male screws passed through boss holes 21*l*, 21*l* from below the lower trunk part 21*b* are screwed onto the bosses with a screw hole 23*a* of the upper ring 23 for the lower trunk part 21*b* to be attached to the upper trunk part 21*a*.

Attached to the trunk body 21 configured in this way are a locking member 26, a pressing member 27, and a locking mechanism 28 (see FIG. 13 and FIG. 15).

Of these, the locking member 26 is configured by a plate that is long in the horizontal direction. This locking member 26 is installed inside a hole 21*n* formed on each fan-shaped end part of the bridge 21*c*. A claw 26*a* is formed at the longitudinal center on the inner surface of each locking member 26. Both end parts of the claw 26*a* have elasticity. A claw 22*a* on each end in the longitudinal direction of the tip 22 is locked on each claw 26*a*. This results in the tip 22 being attached to the trunk body 21. On the outer surface of each locking member 26, a projecting piece 26*b* that extends in the vertical direction is formed in the longitudinal center, and during attachment of the locking member 26 to the trunk body 21, the projecting piece 26*b* is plugged into a slit 210 of the upper trunk part 21*a*.

The pressing member 27 presses the lower ring 25 described later downward, and is configured from a pressing unit 27*a* that protrudes from the trunk body 21 and abuts the top surface of the inward facing bulging part 25*a* of the lower ring 25, and a coil spring 27*b* that energizes the pressing unit 27*a* facing downward.

Each locking mechanism 28 comprises a locking member 28*a* that has a claw 28*d*, a coil spring 28*b* that energizes the locking member 28*a* facing the outside of the upper trunk part 21*a*, and a lock release member 28*c* that has a protruding part 28*e* that protrudes from the bottom surface of the lower trunk part 21*b*.

Also, under normal conditions, the claw 28*d* of each locking mechanism 28 protrudes from the outer periphery of the upper trunk part 21*a* by the energizing force of the coil spring 28*b*, is fitted in a recess 25*b* below the bulging part 25*a* of the lower ring 25 that has ascended, and holds the lower ring 25 in the ascending position (first position).

Also, the protruding part 28*e* of each lock release member 28*c* abuts the top surface of the plan view peripheral part 53*f* of the flywheel 53 that operates at the lower side.

Also, each lock release member 28*c* is moved upward when each protruding part 28*e* contacts the projection 53*g* of the flywheel 53, the locking member 28*a* is in sliding contact with each lock release member 28*c*, and that locking member 28*a* is operated facing inward of the upper trunk part 21*a* in resistance to the energizing force of the coil spring 28*b*, and each claw 28*d* is sunken from the outer periphery of the upper trunk part 21*a*.

As a result, the lower ring 25 for which rotation was restricted by the claws 28*d*, 28*d* of the locking members 28*a*, 28*a* is released from that restriction, and is made to descend by the energizing force of the coil spring 27*b* of the pressing member 27 (second position). The middle ring 24 may also be configured to descend by gravitational force.

The tip 22 covers the top surface of the bridge 21*c* of the trunk body 21.

Claw members 22*d*, 22*d* that extend downward are formed at both end parts in the longitudinal direction of the tip 22. The outward facing claw 22*a* is formed at the bottom edge of each claw member 22*d*. Each claw 28*a* is locked to the claw 26*a* of the inner surface of the locking member 26 attached to the upper trunk part 21*a*.

Also, other claw members 22*b*, 22*b* that extend downward are formed on the tip 22. Inward facing claw 22*c* is formed on the bottom edge of each claw member 22*b*. This claw member 22*b* is inserted in the hole 21*e* of the bridge 21*c* of the upper trunk part 21*a*, and in the inserted state, the claws 22*c* and the teeth 21*g* are adjacent in the circumferential direction.

The upper ring 23 covers and decorates the outer periphery top part of the trunk body 21. Many corrugated parts are formed on the top surface and outer periphery of this upper ring 23. Bosses with a screw hole 23*a*, 23*a*, and bosses 23*b*, 23*b* are formed on the bottom surface of the upper ring 23.

The middle ring is formed to be thin, and has corrugated parts formed on the outer periphery. This middle ring 24 is supported on the trunk body 21 to be able to rotate.

The lower ring 25 is formed to be thick, and has corrugated parts formed on the outer periphery. Also, on the upper edge part outer periphery of the lower ring 25, a recess 25*d* is formed in which a convex part 24*a* of the outer periphery of the middle ring 24 is fitted from above. As a result, when the lower ring 25 is in the ascending position, the recess 25*d* of the lower ring 25 is engaged with the convex part 24*a* of the outer periphery of the middle ring 24, and rotation of the middle ring 24 is obstructed.

Also, the bulging parts 25*a* and the recesses 25*b* are formed on the inner periphery of the lower ring 25. When the lower ring 25 has ascended, the pressing unit 27*a* of the pressing member 27 is abutted on the top surface of the bulging part 25*a*, and also, the claws 28*d* are engaged with the recesses 25*b*. Also, when the lower ring 25 is descended, the bottom surface of the bulging part 25*a* abuts a hinge 21*p* of the lower trunk part 21*b*, obstructing any further descending.

Assembly of the Top Toy 1

The shaft part 10 and the trunk part 20 of the top toy 1 are assembled as described hereafter.

First, the protruding part 12*c* of the shaft part 10 is made to match the recess 53*d* of the flywheel 53 from below, and the flywheel 53 covers the shaft part 10. Also, the shaft side components are matched to the trunk part 20. This state is a state in which the claws 11*c*, 11*c* of the shaft part 10 and the claws 22*c*, 22*c* of the trunk part 20 do not overlap in the vertical direction, specifically, a joining release state. After that, the shaft part 10 is further pressed on the trunk part 20 side. Having done that, the ring 13 is pressed by the claws 22*c*, 22*c* of the trunk part 20, flexing the coil spring 14, and the claws 11*c*, 11*c* of the shaft part 10 are pressed upward further above than the claws 22*c*, 22*c* of the trunk part 20. Also, the shaft side components are rotated in one direction (reverse direction to the rotation of the top) with respect to the trunk part 20. Having done that, the claws 11*c*, 11*c* of the shaft part 10 and the claws 22*c*, 22*c* of the trunk part 20 are in a state overlapping vertically (first rotation position). When the hand is released from the shaft side component in this state, the bottom surface of the claws 11*c*, 11*c* of the shaft part 10 and the top surface of the claws 22*c*, 22*c* of the trunk part 20 are abutted by the energizing force of the coil spring 14 within the shaft part 10. This state, specifically, the state in which the bottom surface of the claws 11*c*, 11*c* of the shaft part 10 and the claws 22*c*, 22*c* of the trunk part 20 are abutted, is the joined state. As a result, the shaft part 10 and the trunk part 20 are joined and the top toy 1 is assembled. In this assembled state of the top toy 1, the protrusions 13*d*, 13*d* of the shaft part 10 and the teeth 21*g*, 21*g* of the trunk part 20 are abutting.

How to Play

Following, battle between top toys 1 is described.

The top toy 1 is rotationally energized by rotating a fork inserted from above in arc-shaped holes 21*d*, 21*d*, and is released into a prescribed field. Then, when there is a collision with the other party top toy, by impact force, rubbing, etc., due to the collision, a force in the direction opposite to the rotation direction of the shaft part 10 acts on the trunk part 20, and that causes the trunk part 20 to rotate relatively in the direction opposite to the rotation direction of the shaft part 10.

Figure 18:
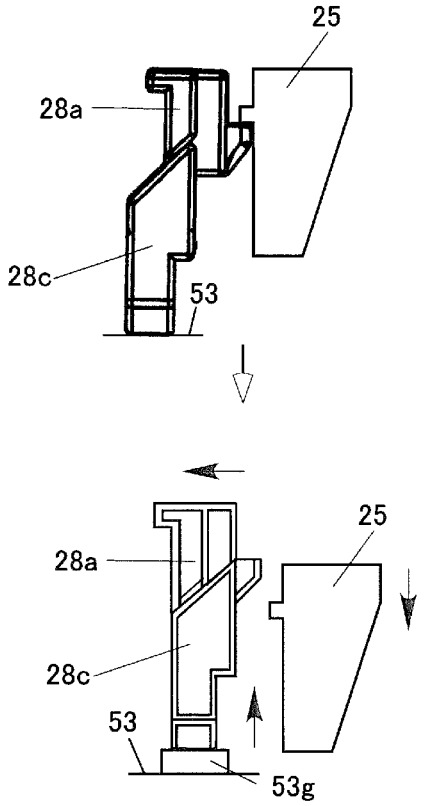
FIG. 18 is a drawing for explaining the operation of the locking mechanism.

At this time, with the shaft part 10 and the trunk part 20, the protrusions 13*d*, 13*d* of the shaft part 10 and the teeth 21*g*, 21*g* of the trunk part 20 abut, and frictional resistance occurs due to the energizing force of the coil spring 14 within the shaft part 10, so for each acting of impact force on the trunk part 20, the shaft part 10 rotates relative to the trunk part 20 and changes the engagement position. Also, as shown in FIG. 18, by the relative rotation of the trunk part 20 and the shaft part 10, when the protruding parts 28*e*, 28*e* of the lock release member 28 abut the projections 53*g* of the flywheel 53, the protruding parts 28*e*, 28*e* are moved upward, and the lock release member 28*c* and the locking member 28*a* are in sliding contact and the locking member 28*a* is moved facing the inward direction of the upper trunk part 21*a*. As a result, the claws 28*d*, 28*d* of the locking members 28*a*, 28*a* sink from the outer periphery of the trunk body 21, and the support of the lower ring 25 by the claws 28*d*, 28*d* is released. Then, when the support of the lower ring 25 by the claws 28*d*, 28*d* is released, the lower ring 25 is descended to a prescribed position by the pressing unit 27*a* of the pressing member 27 that is energized by the coil spring 27*b*, and is free to rotate. Also, the middle ring 24 for which rotation on the lower ring 25 was restricted also separates from the lower ring 25 and is free to rotate. By being free to rotate, it is possible to change the external form, and also to change the offense and defense characteristics of the top toy.

Even after the middle ring 24 and the lower ring 25 are free to rotate, the relative rotation of the trunk part 20 and the shaft part 10 progress according to the angle at which the impact force acts, etc. Also, at the joining release position (second rotation position), specifically, when the projecting pieces 53*e*, 53*e* of the flywheel 53 that rotate integrally with the shaft part 10 reach the end of the arc-shaped holes 21*d*, 21*d*, the claws 22*c*, 22*c* of the trunk part 20 separate from the claws 11*c*, 11*c* of the shaft part 10, so the trunk part 20 separates from the shaft part 10 by the energizing force of the coil spring 14 within the shaft part 10 to be disassembled. The flywheel 53 also breaks away from the shaft part 10.

In this way, with the present embodiment, a gimmick is provided whereby the middle ring 24 and the lower ring 25 go from a state in which rotation is restricted to a state in which they are free to rotate. It is also possible to change the activation timing of the gimmick if the flywheel 53 is exchanged.

Therefore, it is possible to obtain the following effect.

Specifically, customization by the player, in other words, control to some degree of the timing of changes in top characteristics by exchanging of the flywheel 53 is possible, so it is possible to realize a top toy 1 with excellent strategic qualities.

Above, an embodiment of the present invention was explained, but the present invention is not limited to this embodiment, and it goes without saying that various modifications are possible within a range that does not stray from the gist.

Figure 19:
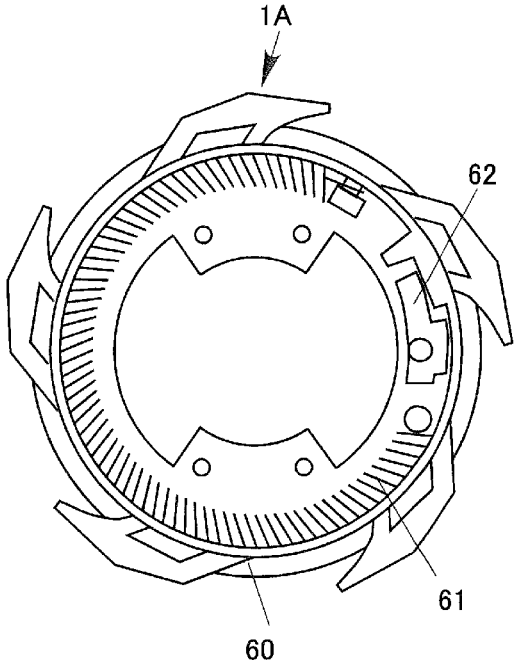
FIG. 19 is a plan view showing the state with a ring of a main part of a modified example of the invention in a first position.

For example, with the above embodiment, the gimmick was to have the middle ring 24 and the lower ring 25 go from a state in which rotation was restricted to a state of being free to rotate, but as shown in FIG. 19, it is also possible to use another gimmick in which by relative rotation of the flywheel 53 with respect to the trunk part 20, a ring 60 like the middle ring 24 and the lower ring 25 is rotated at a prescribed angle with the central axis of a top toy 1A as the center. It is also possible to combine this other gimmick with the abovementioned gimmick.

Figure 20:
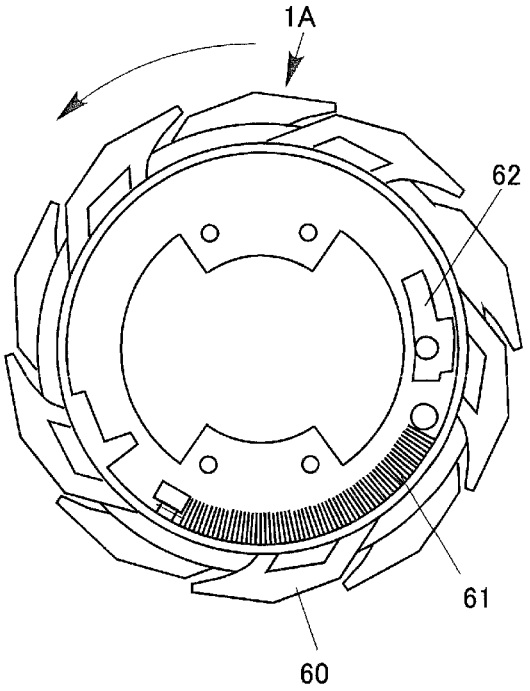
FIG. 20 is a plan view showing the state of the ring of FIG. 20 in a second position.
Figure 21:
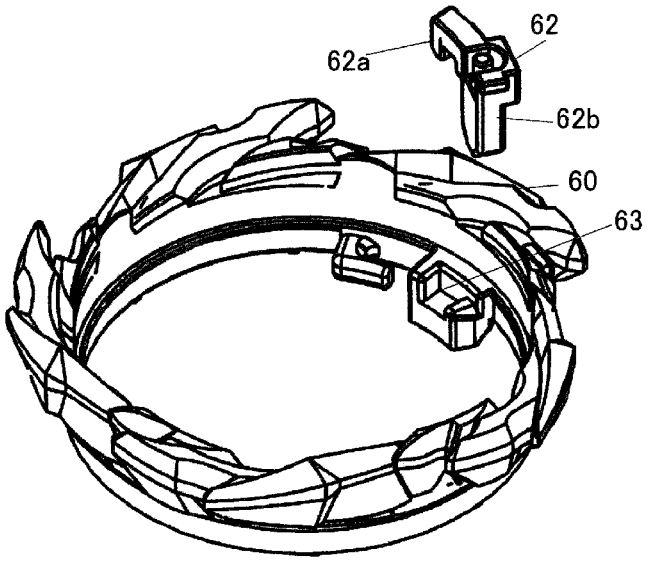
FIG. 21 is a perspective view of a main part of a modified example of the invention.

As shown in FIG. 19 and FIG. 20, with the top toy 1A in this case, the ring 60 is configured to be able to rotate between the first position and the second position, and a coil spring 61 is extended between the trunk body 21 and the ring 60. Also, a locking member 62 that configures the locking mechanism is energized downward by a coil spring (not illustrated), and at the first position, a claw 62*a* of the locking member 62 is engaged with a recess 63 of the ring 60 in resistance to the energizing force of the coil spring 61.

Also, when the flywheel 53 rotates relatively with respect to the trunk part 20 by a prescribed angle, the locking member 62 is pressed upward by a projection (not illustrated), the claw 62*a* of the locking member 62 separates from the recess 63 of the ring 60, and the ring 60 rotates to the second position by the energizing force of the coil spring 61.

It is also possible to have a portion of the outer periphery of the top toy 1 protrude in the radial direction outward by relative rotation of the flywheel 53 with respect to the trunk part 20.

It is also possible to have the projecting part 53*g* be able to move or be detachable with respect to the flywheel 53, and for the player to be able to change the position of the projecting part 53*g* with respect to the flywheel 53. Furthermore, in the case of the top toy in which the flywheel 53 is incorporated in the trunk part 20, it is also possible to provide the projection part 53*g* on the shaft part 10 itself. When providing the projecting part 53*g*, it is preferable that in the state with the trunk part 20 and the shaft side components joined, this not be visible from outside, as with the top toy 1 of the embodiment.

Also, as the top toy to which the present invention is applied, this is not limited to being a top toy for which it is possible for the trunk part 20 and the shaft side component to be disassembled by battling.

Effect of the Invention

According to the top toy of the present invention, by customization by the player, specifically, exchanging of all or a portion of the shaft side components, it is possible to control the timing of changes in the top characteristics to some degree, and possible to realize a top toy with excellent strategic qualities.

What is claimed is:

1. A top toy for rotating in a first direction on a floor around a central axis extending in an axial direction, the top toy being arranged to collide with an opponent top toy, the top toy comprising:

first and second shaft side components, the first shaft side component extending in the axial direction; and a trunk part being configured on the first shaft side component, the trunk part including a trunk body, a moving member being rotatably configured with respect to the trunk body, and a locking mechanism, the moving member being movable between first and second positions in the axial direction, the locking mechanism being configured to lock releasably the moving member at the first position, the first shaft side component being rotatably configured with respect to the trunk part between first and second rotation positions with the axial direction as a center, the trunk part being rotatably configured with respect to the first shaft side component in a second direction being opposite to the first direction when an external force by colliding with the opponent top toy is applied to the trunk part, the first shaft side component including a first projecting part, when the first projecting part is in contact with the locking mechanism, the locking mechanism being configured to release the moving member from the first position, the first shaft side component being interchangeable with the second shaft side component.

2. The top toy according to claim 1, wherein the moving member has a first ring surrounding the central axis, and the first position is higher from the floor than the second position.

3. The top toy according to claim 2, wherein the first ring has rotation obstructed with respect to the trunk body at the first position, and is free to rotate with the central axis at the center at the second position.

4. The top toy according to claim 2, wherein the moving member has a second ring forming a portion of an outer periphery of the trunk part, the second ring is configured on the first ring, the second ring surrounds the central axis, and the second ring is configured to be engaged with the first ring when the first ring is at the first position, wherein the second ring is obstructed to rotate with respect to the trunk body, and the second ring is free to rotate with the central axis as the center when the first ring is in the second position.

5. The top toy according to claim 1, wherein the first shaft side component includes a first shaft part and a first flywheel, the first projecting part is configured at a first position on the first flywheel, the first shaft side component includes a second projecting part being configured at a second position on the first flywheel, and the first position is different from the second position.

6. The top toy according to claim 5, wherein the second shaft side component includes a second shaft part and a second flywheel, the second shaft side component includes third and fourth projecting parts, positions of the first and second projecting parts are different from positions of the third and fourth projecting parts in a top view thereof.

7. The top toy according to claim 6, wherein the top toy has a first motion characteristic when the first shaft side component is equipped, the top toy has a second motion characteristic when the second shaft side component is equipped, the first and second motion characteristics are different.

* * * * *